United States Patent [19]

Tanabe

[11] 4,361,728

[45] Nov. 30, 1982

[54] MULTIPLEX SIGNAL RECEIVER

[75] Inventor: Kenzo Tanabe, Katano, Japan

[73] Assignee: Matsushita Electric Industrial Co., Ltd., Osaka, Japan

[21] Appl. No.: 138,515

[22] Filed: Apr. 9, 1980

[30] Foreign Application Priority Data

Apr. 13, 1979 [JP] Japan ..... 54-45649

[51] Int. Cl.[3] ..... H04H 5/00

[52] U.S. Cl. ..... 179/1 GS; 329/110

[58] Field of Search ..... 179/1 GS; 329/110, 146, 329/50, 121

[56] References Cited

PUBLICATIONS

E. F. Close et al; "A Proposed Am-Am Compatible AM Stereo System", Magnavox Consumer Electronic Co., IEEE Trans on Consumers Electronics, vol. Ce-23, No. 3, 8-77.

*Primary Examiner*—Michael A. Masinick
*Assistant Examiner*—Edward L. Coles, Sr.
*Attorney, Agent, or Firm*—Wenderoth, Lind & Ponack

[57] ABSTRACT

A superheterodyne type multiplex signal receiver for multiplex signal transmission systems for receiving two independent signals transmitted by amplitude modulation and angle modulation of single carriers, and for detecting an intermediate frequency by an intermediate frequency detector when changing the local oscillating frequency by a dial operation to select the received signal. The receiver has a switching circuit so composed that it operates a demodulation circuit which demodulates, from the modulated carrier, the two independent signals, which are then transmitted to two independent audio amplifiers provided at a later stage of an intermediate frequency amplifier for driving two speakers for reception of the multiplex signal, when the intermediate frequency is extremely close to a normally determined frequency. The switching circuit also transmits to the two independent audio amplifiers the demodulated signals obtained from an envelope detection circuit when the intermediate frequency is remote from the normally determined frequency.

3 Claims, 4 Drawing Figures

MULTIPLEX SIGNAL RECEIVER

BACKGROUND OF THE INVENTION

This invention relates to a receiver used for multiplex signal transmission systems which transmit two independent signals by amplitude modulation and angle modulation of single carrier.

The receiver circuit technologies for the multiplex signal are well explained in the following two articles, for example:

(i) "AM stereo: five competing options" IEEE Spectrum, pp 24;14 31 June 1978, (ii) E. F. Close, A. L. Kelsch, R. D. Streeter "A proposed AM-PM Compatible AM Stereo System" IEEE Transaction on C.E., vol CE-23 No. 3, pp 405–408 August 1977.

The displeasing sound and the transient noise are frequently generated by FM receivers. But we could find no discussion on this problem for the reception of the multiplex signal in these prior articles.

To accomplish the objects of the present invention we use an intermediate frequency detector and a signal switching circuit in a signal demodulation circuit block.

FIG. 1 shows an example of a receiver circuit block diagram used for the multiplex signal transmission systems. Here an explanation is given of amplitude modulation by (L+R) and angle modulation by (L−R), where L is the left signal covering stereo signals and R is the right signal.

In FIG. 1, the received signals at an input terminal 1 are applied to a frequency mixer 2 along with the local signals generated by a local oscillator 3, and an output of this frequency mixer 2 is applied through an intermediate frequency filter 4 to a limiter 5 and an intermediate frequency amplifier 7. An output signal generated by the limiter 5 is applied to a demodulator 6 which demodulate the (L−R) signals from the angle modulated carriers. On the other hand, an output signal generated by the intermediate frequency amplifier 7 is applied to an envelope detector 8 which demodulate the (L+R) signals from the amplitude modulated carriers. The (L−R) and (L+R) signals generated by the demodulator 6 and the envelope detector 8 are applied to a matrix circuit 9, and L and R signals are obtained at output terminals 10 and 11 of the matrix circuit 9. These L and R signals are applied to a stereo two-channel amplifier (not shown) and drive two speakers (not shown).

In a receiver of such construction, complete stereo signals can be demodulated when the frequency difference between the carrier frequency at the input terminal 1 and the oscillating frequency of the local oscillator 3 matches correctly with a predetermined intermediate frequency. However, as it is also well known, a considerable level of noise is generated from the demodulator 6 for demodulation of the angle-modulated signal when the frequency difference is slightly deviated from the predetermined intermediate frequency (i.e. at detuning due to an insufficient manual tuning operation). Considerable noises are thus contained in the stereo L and R signals obtained at the output terminals 10 and 11. This kind of noise appears also as a transient noise at the fringe area of an exact tuning point during searching for reception of the multiplex signal by dial knob operation and causes an unpleasant feeling to the operator of the receiver.

In FM receivers generally on the market, this type of problem is solved by using a muting function which does not produce sound from the speakers at times other than exact tuning. However, in the subject of this invention, the premise is that at least one of the signals among the multiplex signals will be amplitude modulated signal. If we apply the muting function used by FM receivers to the multiplex signal transmission system used in AM receivers, it would cause an unpleasant dial knob operation feeling which would be different from that of previous AM receivers.

In order to eliminate the above-noted shortcomings, this invention detects whether or not the intermediate frequency is the normal predetermined frequency, and performs (1) demodulation of the stereo signal in the same way as FIG. 1 when the intermediate frequency is the normal predetermined frequency, and (2) demodulation of only the (L+R) signal obtained at the envelope detector for detecting only the amplitude modulation component when the intermediate frequency is not the normal predetermined frequency. By this, the above mentioned unpleasant feeling is eliminated.

SUMMARY OF THE INVENTION

An object of this invention is to eliminate the displeasing sound caused by an angle demodulated signal at a fringe area of an exact tuning point during reception of the multiplex signal.

Another object of this invention is to eliminate the transient noise also caused by the angle demodulated signal at the fringe area of the exact tuning point during searching for reception of the multiplex signal by dial knob operation.

Another object of this invention is to realize a fine dial operation feeling.

Hereinafter, this invention will be described in detail along with accompanying drawings in which:

DESCRIPTION OF PREFERRED EMBODIMENT

Figure 1:
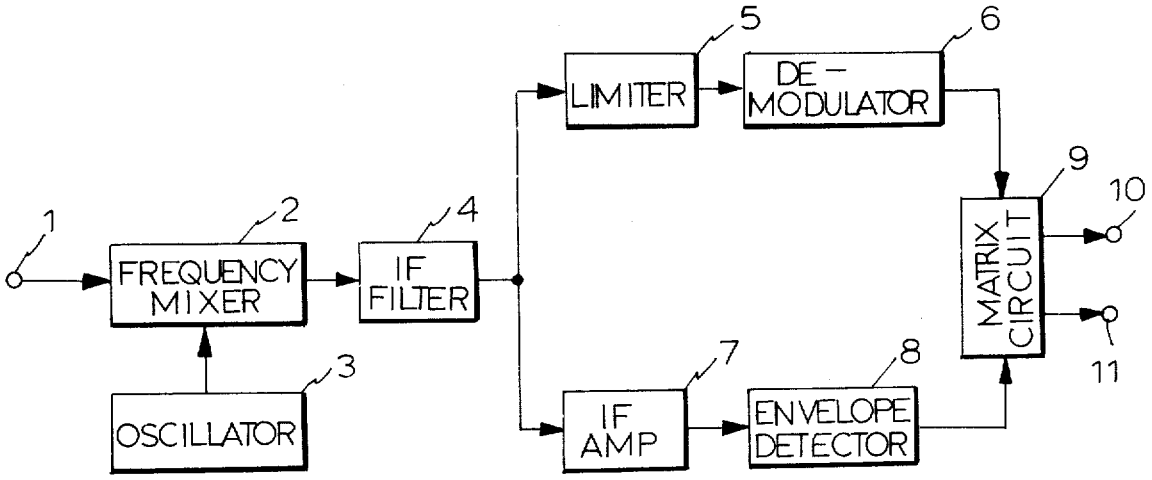
(PRIOR ART) FIG. 1
FIG. 1 shows an example of a receiver circuit block diagram.
Figure 2:
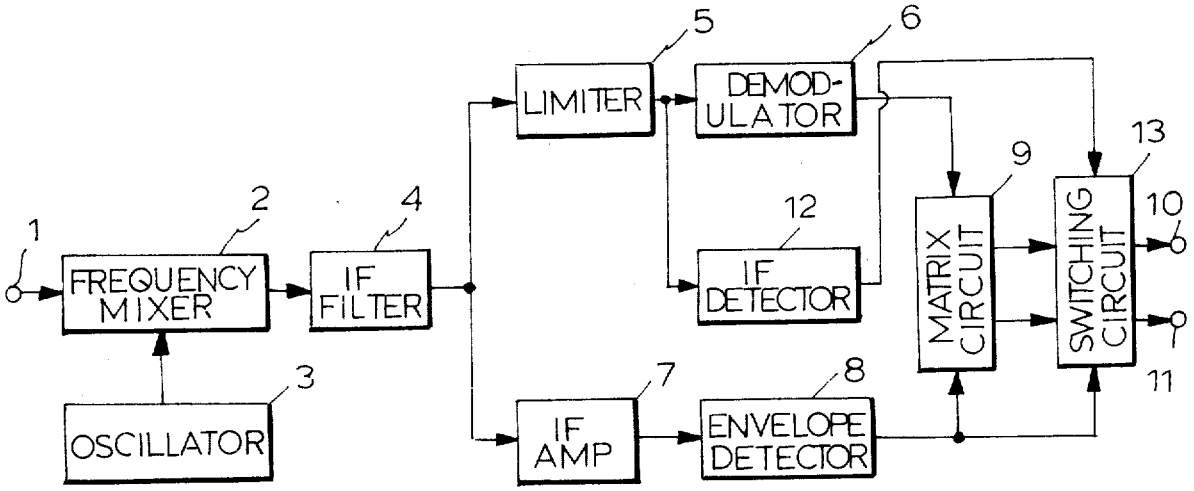
FIG. 2 shows a demodulator circuit using an intermediate frequency detector and a signal switching circuit according to this invention.

FIG. 2 explains an application example of this invention. Blocks with the same numbers as FIG. 1 are blocks with the same functions as those explained in FIG. 1, and therefore, explanations of the operations of those blocks are omitted.

In FIG. 2, 12 is an intermediate frequency detector for the detection of whether or not the frequency of the output signal obtained from the limiter 5 (amplitude limiting amplifier) is equal to a predetermined frequency, and its output signal drives a signal switching circuit 13. This signal switching circuit 13 is supplied with the L and R signals obtained at the matrix circuit 9 and is also supplied with the output signal (L+R) obtained at the envelope detector 8.

Figure 3:
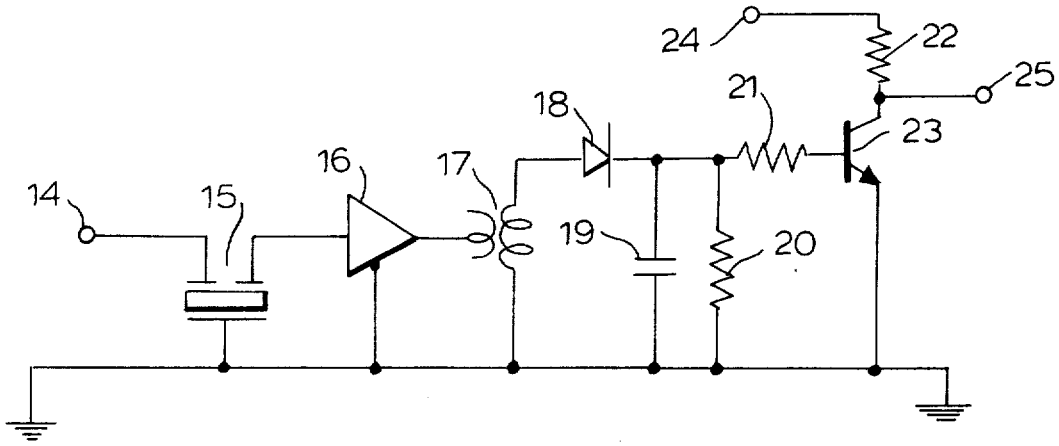
FIG. 3 shows an example of a circuit diagram of the intermediate frequency detector.

FIG. 3 shows an example of a circuit diagram of the intermediate frequency detector 12, wherein an input terminal 14 is supplied with the output signal obtained from the limiter 5. The signal applied to the input terminal 14 is further applied to an amplifier 16 through a band pass filter 15, which only allows to pass signals whose frequency is equal to or extremely close to the normal predetermined frequency. The pass band width of the filter 15 should be several hundred Hz to several KHz according to the characteristics of the intermediate frequency filter 4 in FIG. 1, because, the displeasing sound or the treatment noise will occur when the carrier frequency exists at the fringe area of the pass band of the filter 4. This band pass filter 15 can be realized by a ceramic filter or the like with a pass band width of several hundred Hz and a center frequency of 455 kHz. The output signal level of the amplifier 16 is detected by an envelope detecting circuit, composed of a transformer 17, a diode 18, a capacitor 19, and a resistor 20, and drives a switching transistor 23, which has a base resistor 21 and a load resistor 22, A terminal 24 in FIG. 3 is for the connection of the power supply to the switching transistor 23. An intermediate frequency detecting signal obtained at an output terminal 25 drives the switching circuit 13 shown in FIG. 2.

Figure 4:
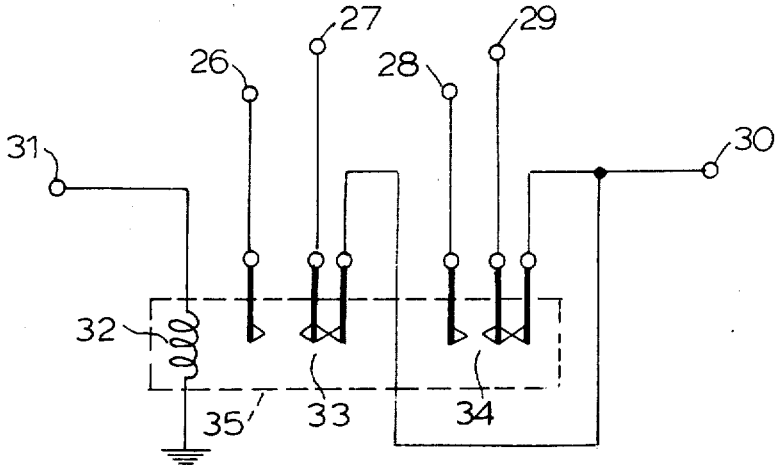
FIG. 4 shows an example of the signal switching circuit.

FIG. 4 is an example of an actual construction of the switching circuit shown in FIG. 2 with relays having two circuits and two contacts. A power supply terminal 31 of a relay winding 32 is connected, for example, to the output terminal 25 shown in FIG. 3. A block 35 surrounded by dotted lines shows a two circuit and two contact relay. Here, the operation of the circuit in FIG. 4 is explained in relation to FIG. 3. The electric potential of the output terminal 25 of the intermediate frequency detector shown in FIG. 3 becomes almost equal to the ground potential when the frequency of the intermediate frequency signal applied to the input terminal 14 is the predetermined frequency or a frequency extremely close to it. Furthermore, when terminals 25 and 31 shown in FIG. 3 and FIG. 4 are connected, relay 35 will not operate. On the other hand, when the frequency of the intermediate frequency signal applied to the input terminal 14 is considerably different from the predetermined frequency, the switching transistor 23 turns off and the electric potential of the terminal 25 becomes higher than the ground potential. Therefore, the relay 35 will operate.

The state of relay 35 of FIG. 4 indicates when the frequency of the intermediate frequency signal is a frequency considerably different from the predetermined frequency. Considering the relationship between the terminals 26 to 30 of the relay contacts and FIG. 2, terminals 26 and 28 are connected to the output end of the matrix circuit 9, terminal 30 is connected to the output end of the envelope detector 8, and terminals 27 and 29 are used as output terminals 10 and 11, respectively.

The other blocks shown in FIG. 2 are those often used in past AM radio receivers or FM radio receivers, and therefore, a detailed explanation is omitted.

In some cases, in the intermediate frequency detector 12 shown in FIG. 3, the electric field strength fluctuates widely, as when used for car radio receivers. When there are wide fluctuations, the electric potential of the output terminal 25 fluctuates so that sometimes causes instability in operation of relay 35 shown in FIG. 4. In this case, it is useful to connect one of the well known PLL circuits between the input terminals 14 and the band pass filter 15 shown in FIG. 3. The VCO signal contained in this PLL circuit can be applied to the band pass filter 15, and a well-known Schmidt circuit having hysteresis characteristics can be attached to the output terminal 25.

The explanation above was made using a relay as the switching circuit 13. But a semiconductor switch using transistors, MOSFETs, or the like can also be used. In addition, the explanation was made using the envelope detector 8 as an amplitude demodulation circuit, but of course a synchronous detector can be used to obtain good distortion characteristics. Furthermore, various changes can also be made in the form of intermediate frequency detector 12, for example, the d.c. output component generated by demodulator 6 for demodulating the angle modulated signal can of course be used to detect the intermediate frequency. For such a detector (12), a ratio frequency detecting circuit, quadrature frequency detecting circuits, pulse count frequency detecting circuits and the like can be used.

For the proper judgement of the tuning operation of the above receiver, one can insert a display element in series with the resistor 22 of FIG. 3 or can insert a display element in parallel with the relay winding 32 of FIG. 4.

With this invention, as explained above, it is possible with a simple circuit configuration, to eliminate the displeasing sound and the transient noise in the demodulated L and R signals at the fringe area of an exact tuning point during reception of the multiplex signal. And it is also possible to get a fine dial operation "feeling" when conducting tuning operation by a dial knob of a receiver used for the multiplex signal transmission system in which two independent signals are transmitted by amplitude modulation and angle modulation of a single carrier.

What is claimed is:

1. A multiplex signal receiver used for multiplex signal transmission systems which transmit two independent signals by amplitude modulation and angle modulation of a single carrier, said receiver comprising:

a switching circuit;

an angle demodulator for demodulating an angle modulated signal component of a signal received by said receiver;

an envelope detector for demodulating an amplitude modulated signal component of said received signal;

an intermediate frequency detector for detecting an intermediate frequency and for outputting a control signal for controlling said signal switching circuit; and a matrix circuit for modifying an output signal of said angle demodulator and an output signal of said envelope detector by addition and subtraction thereof so as to obtain two output signals for driving a two channel amplifier through said signal switching circuit;

wherein said signal switching circuit is supplied with said two output signals of said matrix circuit and the output signal of said envelope detector and selects as its output signals either said two output signals of said matrix circuit or said output of said envelope detector according to said control signal;

and wherein said selection of the output signals of said signal switching circuit is dependent upon the closeness of said intermediate frequency to a predetermined frequency, and wherein the frequency range of said intermediate frequency for selecting said two output signals of said matrix circuit as the output signals of said signal switching circuit is set according to the characteristics of an intermediate frequency filter included in said intermediate frequency detector.

2. A multiplex signal receiver according to claim 1, wherein means are provided for adding hysteresis characteristics to said signal switching circuit.

3. A multiplex signal receiver according to claim 1, wherein a display element is connected to said signal switching circuit for indicating a state of exact tuning.

* * * * *